US006157036A

United States Patent [19]

Whiting et al.

[11] Patent Number: 6,157,036

[45] Date of Patent: Dec. 5, 2000

[54] SYSTEM AND METHOD FOR AUTOMATICALLY ELUTING AND CONCENTRATING A RADIOISOTOPE

[75] Inventors: James S. Whiting, Los Angeles; Alexander N. Li, Granada Hills; Neal L. Eigler, Pacific Palisades, all of Calif.

[73] Assignee: Cedars-Sinai Medical Center, Los Angeles, Calif.

[21] Appl. No.: 09/205,661

[22] Filed: Dec. 2, 1998

[51] Int. Cl.[7] ..... G21H 1/00; G21H 5/00; B65B 3/04

[52] U.S. Cl. ..... 250/432 PD; 250/432 R; 250/430; 376/186; 423/2; 423/249; 423/54; 424/1.11

[58] Field of Search ..... 250/432 PD, 430, 250/432 R; 376/186; 423/2, 54, 249; 424/1.11

[56] References Cited

U.S. PATENT DOCUMENTS

| | | | |
|---|---|---|---|
| 3,655,981 | 4/1972 | Montgomery et al. | 250/106 T |
| 4,296,785 | 10/1981 | Vitello et al. | 141/105 |
| 4,387,303 | 6/1983 | Benjamins | 250/432 PD |
| 4,783,305 | 11/1988 | Forrest | 376/186 |
| 4,833,329 | 5/1989 | Quint et al. | 250/432 PD |
| 4,853,546 | 8/1989 | Abe et al. | 250/432 PD |
| 5,039,863 | 8/1991 | Matsuno et al. | 250/432 PD |
| 5,109,160 | 4/1992 | Evers | 250/432 PD |
| 5,186,913 | 2/1993 | Knapp, Jr. et al. | 423/2 |
| 5,382,388 | 1/1995 | Ehrhardt et al. | 252/635 |
| 5,580,541 | 12/1996 | Wells et al. | 424/1.11 |
| 5,729,821 | 3/1998 | Knapp et al. | 423/2 |

OTHER PUBLICATIONS

A.P. Callahan, et al. "The Use of Alumina 'SepPaks®', as a Simple Method for the Removal and Determination of Tungsten–188 Breakthrough from Tungsten–188/Rhenium–188 Generators." *Appl. Radiat. Isot.* vol. 43, No. 6, pp. 801–804 (1992).

F.F. (Russ) Knapp, Jr., et al. "Availability of Rhenium–188 from the Alumina–Based Tungsten–188/Rhenium–188 Generator for Preparation of Rhenium–188–Labeled Radiopharmaceuticals for Cancer Treatment*" *Anticancer Research,* 17: 1783–1796 (1997).

S. Guhlke, et al. "Convenient Concentration of [$^{188}$ Re]Perrhenate or [$^{99m}$Tc]Pertechnetate Eluates from Tungsten–188/Rhentum–188 or (n, γ) Produced Molybdenum–99/Technetium–99m Generators to High Specific Volumes." *Journal of Labeled Compounds and Radiopharmaceuticals,* XL, 294–296 (1997).

F.F. (Russ) Knapp, Jr. "Rhenium–188—A Generator–Derived Radioisotope for Cancer Therapy." *Cancer Biotherapy & Radiopharmaceuticals,* vol. 13, No. 5 (1998).

F.F. Knapp, Jr., et al. "Use of a New Tandem Cation/Anion Exchange System with Clinical–Scale Generators Provides High Specific Volume Solutions of Technetium–99m and Rhenium–188." In, Proceedings, International Symposium on Modern Trends in Radiopharmaceuticals for Diagnosis and Therapy, sponsored by the International Atomic Energy Agency (IAEA), Lisbon, Portugal, Mar. 30–Apr. 3, 1998; IAEA, Vienna, pp. 419–425 (1998).

*Primary Examiner*—Bruce C. Anderson
*Assistant Examiner*—Nikita Wells
*Attorney, Agent, or Firm*—Sidley & Austin

[57] ABSTRACT

A system and method for eluting one or more radioisotope processing elements, such as generators and/or concentration and purification components, with a gas over eluent delivery mechanism is disclosed. The system is adapted to an elution/concentration system using two such mechanisms, one for an initial elution of one or more generators, and a second for "re-elution" of concentrated and purified radioisotope contained in a concentration subsystem. The operation of such a dual mechanism system may also be completely or partially automated. The invention also discloses a concentration subsystem containing all single-use components needed for concentration and/or purification, as a single use, self sealed, cartridge that can safely store waste eluate for safe and simple disposal.

27 Claims, 4 Drawing Sheets

SYSTEM AND METHOD FOR AUTOMATICALLY ELUTING AND CONCENTRATING A RADIOISOTOPE

FIELD OF THE INVENTION

This invention relates to the field of nuclear medicine and more particularly to systems and processes for producing medically useful radioisotopes. Although the present invention broadly pertains to the production of radioisotopes, it is especially, but by no means exclusively, suited for the production of radioisotopes that require concentration, such as rhenium-188.

BACKGROUND OF THE INVENTION

The application of numerous, generator-produced, radioactive isotopes in patients has significantly advanced the fields of medical imaging, diagnosis and even therapy. Such patient-grade, generator-produced, radioisotopes are often called "daughter" radioisotopes because they are formed by the radioactive decay of different nuclides, called "parent" radioisotopes having considerably longer half-lives. Daughter radioisotopes are harnessed in a process called "elution," whereby a sterile "eluent," such as a sodium chloride solution, passes through a radioisotope generator column, upon which a decaying parent radioisotope is adsorbed, and exits as an "eluate" containing the daughter radioisotope.

Certain daughter radioisotopes, such as technetium-99 m, are primarily gamma photon emitters, making them ideal for imaging applications. Conventionally, these types of radioisotopes are prepared for medical use in a single elution step; that is, by forcing the eluent through the generator and capturing the resultant eluate.

Other radioisotopes decay with beta-charged emissions that are more readily absorbed by the patient, thus making them more suitable for therapy applications, such as radiolabeling, or radioimmunotherapy, and even pain therapy. Rhenium-188, which is eluted from a Tungsten-188 parent, is one such type of radioisotope whose beta emissions are entirely absorbed by the patient's body and has a relatively short-half life of 17.0 hours. These characteristics make Re-188 particularly useful for the treatment of tumors, i.e. radiolabeling, and other diseases and disorders. However, to be effective for such applications, Re-188 eluate, and other similar radioisotopes solutions, must be highly concentrated. Thus, they require additional purification and concentration steps.

In order to increase the activity concentration of the eluate produced by a typical generator, such as an alumina-based, tungsten-188/rhenium-188 (W-188/Re-188) generator, and to obtain treatment-quality Re-188, the eluate must be chemically "filtered" to remove traces of the parent radioisotope, alumina and chloride anions from the solution. The purified Re-188 isotope is then trapped, or concentrated, in an appropriate "radioisotope trap," such as an ion exchange column, and is then finally re-eluted into a container with a desired volume of fresh eluent.

One such system and process, developed by the Oak Ridge National Laboratory (ORNL), is shown in FIG. 1. In particular, the system 1 calls for the use of a constant flow-rate pump 2, namely, a peristaltic pump, to drive a desired volume of saline solution eluent stored in a container or sack 4, at a desired rate, through a series of single-use columns connected by tubing. The eluent is pumped through a radioisotope generator 6 and a filter 8 and the resultant eluate is forced through a series of single-use ion exchange columns 10 and 12. The first column 10 shown is a silver halide precipitation column ("Maxi Clean IC-Ag" column, Alitech, Inc., Deerfield, Ill.) that traps therein all of the chloride anions and permits the passage of any non-halide ions in the solution. An anion exchange column 12 (Accell Plus QMA® anion column, Waters, Inc., Milford, Mass.) referred to hereinafter as a radioisotope trap, then traps the perrhenate anions (the daughter radioisotope) therewithin, thus permitting the resultant eluate, which should contain only minimal radioactivity, to pass as a waste solution into a waste collection container 14 for disposal. Once the required volume of solution has been eluted, the operator disables the pump and manually adjusts each of the three-way valves 16, 18 and 20 to bypass the generator 6 and impurity traps 10 and 12 and to redirect the output from the waste container 14, to create a direct fluid path from the pump 2 to a collection vial 22. Then, in the second step, the operator reactivates the pump 2 to drive a small, predetermined, volume of fresh eluent from the supply 4 through tubing 17 and through the radioisotope trap 12, in order to elute, or more precisely, re-elute, the daughter radioisotope adsorbed on the column in the trap 12, into the sterile collection vial 22 as a sodium perrhenate solution.

While the ORNL system sets forth the basic chemistry, components and a method for the concentration and elution of discreet quantities sodium perrhenate, the system and method have several drawbacks. One problem is that the method relies on relatively significant operator intervention prior to, during, and after each elution. In particular, after setting up the system, the operator needs to set the flow rate of the pump, precisely track the on-time of the pump for the first elution, disable the pump, adjust the valves 16 and 18 to redirect the eluent for the second elution through the tube 17 to the radioactive trap 12, restart the pump for precisely long enough for the eluent to pass through tube 17, valve 18, radioisotope trap 12 (where, upon exiting, it becomes an eluate), and finally to valve 20. Just before this eluate reaches valve 20, valve 20 must be adjusted to redirect flow away from the waste container 14 and to the collection vial 22. This complex procedure is one method for maximizing the radioactive concentration in the collection vial. Alternatively, the operator can flush the system with air between elutions to purge the tubing of residual liquid that would otherwise dilute the radioactive eluate from the second elution. The air flush technique has the second advantage of reducing residual activity within the columns and tubing.

All of these steps tends to 1) be time-consuming and inefficient, especially for labs that engage in multiple, continuous elutions; 2) increase the potential for human error, which can be dangerous, wasteful or both; and 3) unduly expose the operator or operators to radiation.

It is understood that above-described system could be fully electronically controlled so that the electric pump would be automatically activated for the appropriate period of time, the three-way valves would then automatically be adjusted to their second stage positions, and the pump then reactivated for the final elution step. Nonetheless, such a system would add considerable complexity and cost to the conventional system, with the addition of a processor and electronic timer scheme. Further, such an automated system would not adequately address all of the aforementioned problems. Thus, it would desirable to have an inexpensive, simple, mechanical elution/concentration system that automatically produces concentrated radioisotopes and air purges the system, thus significantly reducing reliance on human intervention.

Further, using a constant, flow rate, electric pump to drive the solution through the system has drawbacks. Such pumps are relatively expensive, are ill-suited for pumping the air needed to purge the system after an elution, and run the risk of creating a dangerous over-pressure condition in the, albeit relatively rare, event of a blockage in the fluid line. Additionally, the requirement of an electric pump adds to system complexity and cost when the need to design for the different voltage supplies of various foreign countries is considered. Thus, it would be desirable to eliminate the need for a constant, flow rate, pump and, even more broadly, the need for electrical power, to both reduce system cost and to enable the production of a single design for the worldwide market.

A third drawback of the ORNL system is that it provides for separate, single use, concentration columns that must be properly connected and shielded by the operator for each fresh elution procedure. Further, the eluate waste created by the first stage elution must be properly disposed of. The set up and handling of these discrete components requires training, is inefficient, increases the risk of operator exposure, and creates the additional problem of the safe disposal of the spent, radioactive exchange columns and fluid waste. Thus, it would be desirable to have a system that minimizes component handling during both the set up and disposal procedures.

Another issue not fully addressed by preexisting systems relates to the inefficiency of the elution of generators. As a generator ages, its radioactive yield decreases due to its decay. While the elution of a fresh generator may yield a substantial quantity of the daughter isotope, a subsequent elution of that same generator may not yield enough end product for the procedure to be worthwhile. However, since each generator is relatively costly, it would be desirable to have a system that could easily and efficiently elute more than one aged generator in series, thereby producing, with a single elution, a useful quantity of the daughter radioisotope. This would effectively extend the useful life of generators that are located together and could decrease the medicine's cost per treatment.

In sum, a need therefore exists for a system and method that automatically concentrates and elutes radioisotope solutions, that automatically prepares the system for subsequent elution procedures, that does not rely on a costly and complex, processor-controlled pump arrangement, and that, at the same time, tends to minimize operator intervention and handling of the components and waste by-products.

SUMMARY OF THE INVENTION

The present invention, which tends to address this need, resides in an improved radioisotope concentration system and method that implements an improved mechanism and method for the elution of radioisotopes. This system and method provides significant advantages over known systems and methods, in that it, among other things, (a) automates the concentration and elution steps without the need for an electric pump system and electronic control of the pump; (b) automatically and immediately purges the fluid lines with a gas to flush the eluent through the system and to prepare the system for a subsequent procedure; (c) tends to minimize the handling of the radioactive components and waste product; (d) significantly decreases operator set up time; and (e) permits reclamation of unused isotope.

According to the present invention, a novel gas-over-eluent, fluid delivery mechanism for eluting one or more processing elements having inlets and outlets, is disclosed. The mechanism includes a vertically-disposed reservoir having an output feed at the bottom thereof for connecting to the inlet of one of the one or more processing elements, a predetermined volume of eluent contained in the reservoir, a predetermined volume of gas contained in the reservoir, separated from and positioned over the predetermined volume of eluent, and a force-limited, pressure-supplying mechanism that forces the volume of eluent and then the volume of gas through the reservoir output feed and into and through the one or more processing elements. The pressure-supplying mechanism thus elutes the one or more processing elements with the predetermined volume of eluent. Immediately following the elution, the pressure-supplying mechanism purges the one or more processing elements with the predetermined volume of gas.

The gas-over-eluent arrangement provides numerous advantages over preexisting, conventional systems. First, it tends to provide an automatic and relatively safe means for purging the system of eluate that may contain radioactive components, immediately following an elution. Further, this design permits a fixed volume of eluent to pass through the process, regardless of the number of processing elements and distance through which the eluent (or eluate) solution must travel. Simply, the greater the distance the solution must travel, due to an increased number of processing elements, tubing length or other factors, the more gas that is preloaded into the delivery mechanism to drive the fixed volume of solution.

The improved delivery system may be advantageously designed into either of the two types of conventional radioisotope elution systems, broadly described above as 1) single step elution systems (i.e. for processes that do not require concentration, such as in the production of Tc-99m); and 2) elution and concentration systems (i.e. for the production of Re-188). Accordingly, the "one or more processing elements," as used herein, refers to any element through which the eluent (or eluate) may pass. This includes, at a minimum, single radioisotope generator. However, it also includes multiple radioisotope generators connected in series. In this case, the predetermined volume of gas is determined by the number of generators being eluted in series and the distance that the predetermined volume of eluent must travel. The one or more processing elements may alternatively comprise concentration and purification components, including, for instance the ion exchange columns described in more detail below, or a combination of one or more generators in series with concentration and purification components.

In a more detailed embodiment, the force-limited, pressure-supplying mechanism comprises a plunger having a head positioned within said reservoir and over the volume of gas and a plunger pressure source that applies a downward force upon the plunger, the volume of gas, and thus the volume of eluent, in order to propel the eluent and then the gas through the reservoir, and through the one or more processing elements.

An improved system for producing a concentrated radioisotope is also disclosed herein. In the preferred embodiment, the system includes a generator for producing an eluate containing a desired radioisotope to be concentrated, a radioisotope concentration subsystem in fluid communication with the generator that removes impurities from the eluate and that concentrates the radioisotope therein, a radioisotope collection vessel in fluid communication with the concentration subsystem for collecting therein a desired volume of prepared radioisotope solution, and two, gas-over-eluent, fluid delivery mechanisms. "Impurities," as used herein, refers to undesired chemical species, such as chloride anions that could interfere with further processing steps, cations, and/or radionuclide impurities, such as Tungsten W-188 breakthrough from the generator, which are undesirable for medical use in the patient. The "gas" in the fluid delivery mechanism may be any appropriate gas, but will typically be filtered air. The collection vessel may be any appropriate sterile receptacle for the isotope, such as a vented collection vial, a waterproof bag, or a syringe.

A first gas-over-eluent delivery mechanism stores a first measured volume of fluid comprising a first measured volume of eluent solution and a first measured volume of a gas positioned over the first volume of solution, and includes a first pressure-supplying source that applies a first pressure upon the first volume of gas to force the first volume of eluent and then gas through the generator and the radioisotope concentration subsystem. A second gas-over-eluent delivery mechanism includes a second measured volume of fluid comprising a second measured volume of eluent solution and a second measured volume of a gas positioned over the second volume of solution and includes a second pressure-supplying source that applies a second pressure upon the second volume of gas to force the second volume of eluent and then gas through the concentration subsystem and into the radioisotope collection vessel. It should be understood, however, that the presently described gas-over-eluent invention in not limited to two gas-over-eluent delivery mechanisms. The number of mechanisms can equal the number of distinct elution steps needed or desired for a given procedure.

The multiple, separate gas-over-eluent mechanisms provide numerous advantages over prior systems. First, they eliminate the need for an electric pump to supply the eluent to the generator and rest of the system. Second, since each mechanism is preloaded with a predetermined volume of eluent and gas, the need to track the volume of eluent that is supplied from a large eluent source during the procedure is eliminated. Thus, the need for timing the system, whether by the operator, or automatically via timers, and the possibility for such error during an elution is also substantially eliminated.

After the first mechanism evacuates its prestored eluent and flushes the system with its gas, the second mechanism is activated to re-elute the radioisotope and to produce the final product at the desired concentration. This can be accomplished manually by the operator by applying the second pressure-supplying source to the second volume of fluid after observing that the first container is spent. Alternatively, the second elution may be initiated automatically, as described in detail below. Further, any subsequent stage mechanism, if present, can be activated after its preceding stage mechanism completes its task.

In one preferred embodiment, the first and second pressure supplying sources are constant pressure supplying sources. As one example, gravity may supply the constant pressure upon the first and second gas-over-eluent combinations by means of simple weights of predetermined mass. In an alternative embodiment, the first and second pressure supplying sources are variable rate pressure supplying sources. For example, the first pressure supply source may be a first compressed spring having a spring coefficient k1 and the second pressure supply source is a second spring having a spring coefficient k2.

In a more particular embodiment, the first delivery comprises a first downwardly-positioned syringe having a barrel for containing the first volume of fluid, an output feed, and a plunger that fits into the barrel and is positioned over the output feed. A first pressure supplying source, such as a mass or spring, is connected to the plunger. "Downwardly-positioned" refers to the orientation of the syringe being substantially vertically oriented so that the plunger is at the top of the syringe and pushes downwardly towards the output feed, or outlet. Similarly, the second gas over eluent delivery mechanism, typically smaller than the first, comprises a second syringe having a barrel for containing a second volume of fluid, an output feed and plunger, and a second pressure supplying source connected to the plunger that supplies a downward force to the plunger.

In the broadest embodiment, the radioisotope concentration subsystem includes at least one processing element in fluid communication with the generator that processes that radioisotope therein. In a more particular embodiment, the at least one processing element comprises at least one impurity trap in fluid communication with the generator for removing impurities from the eluate and a radioisotope trap in fluid communication with the at least one impurity trap for concentrating therein the desired radioisotope in the eluate and for permitting the passage of the eluate therethrough for disposal. As used herein, "impurity trap" refers to any conventional element that processes, purifies or further prepares an eluate solution, such as an ion exchange column, chromatography column or filter. In this more detailed embodiment, the second gas-over eluent delivery mechanism forces the second measured volume of eluent and then the second measured volume of a gas into and through the radioisotope trap and into the radioisotope collection vessel to complete the process.

The system further includes a waste receptacle for receiving the eluate produced by the generator and passed by the radioisotope trap and supplied by the first gas-over eluent delivery mechanism. In a preferred embodiment, the waste receptacle is contained within the radioisotope concentration subsystem, so that the waste may be safely disposed with the subsystem, without a separate handling step.

A preferred method of operating the system may be completely or partially automated. Such method entails first applying a first pressure on a first volume of gas to force a first volume of eluent and then the first volume of gas through a generator and a concentration subsystem and into a fluid waste receptacle, thereby eluting the daughter radioisotope from the generator, concentrating the eluate in a radioisotope trap in the subsystem, and purging the system of fluid. Only then may the system apply a second pressure on a second volume of gas to force a second volume of eluent, and then the second volume of gas through the radioisotope trap once again and into a sterile, vented collection vessel, thereby re-eluting the concentrated daughter radioisotope into the collection vessel and purging the concentration subsystem of fluid.

The second elution, or "re-elution", step may be activated by an operator or may commence automatically upon sensing the completion of the first elution. This operation may be automated either mechanically or electronically. As an example of a mechanically automated embodiment, the second pressure supply may be a spherical mass (i.e. a ball) that rests at the top of a downwardly titled track that terminates at the top of the plunger of the second syringe. The sphere is prevented from rolling down to and atop the plunger via a stopper mechanism. However, as soon as the plunger of the first syringe mechanism collapses into the barrel, the stopper mechanism automatically releases the sphere, allowing it to roll down the ramp and onto the plunger, to serve as the second pressure supply, and to thus commence the second elution step.

A three-way valve is provided to redirect the fluid path which flowed in the first elution from the radioisotope trap to the waste receptacle to one that flows, in the second elution from the radioisotope trap to the collection vessel. The valve may be manually adjusted to redirect the flow after the gas from the first volume completes its purging function. Alternatively, the valve may be mechanically actuated, for example, by the rolling spherical mass described above, or may be electronically controlled and programmed to move to its "second" position after a sensor detects that the first elution is complete.

The gas-over-eluent delivery mechanism and method also provide a relatively simple and low cost means for eluting two or more generators connected in series and particularly, aged and used generators that are still capable of producing some eluate but not enough to warrant subsequent, individual elutions. The application of gas to force the eluent completely through the multiple generator system permits the use of the same volume eluent as would be required to elute a single generator. This feature enables the use of only one set of costly ion exchange columns, which have a limited volume capacity, to concentrate the eluate from the multiple generators. This also provides an efficient solution to the problem of radioisotope waste.

A still more detailed aspect of the invention includes a single-use, self-sealed, radioisotope concentration cartridge for concentrating therein a radioisotope contained in an eluate solution generated by a radioisotope generator. The eluate solution is carried by a first fluid delivery system which prepares the radioisotope to be re-eluted by a second fluid delivery system and to be carried into a sterile, collection vial via a third fluid delivery system. The cartridge includes at least one processing element, which, in the preferred embodiment, includes at least one impurity trap and a radioisotope trap serially connected to the at least one impurity trap, and a sealed, radioactively shielded, container that houses the at least one impurity trap and radioisotope trap. In particular, the container includes at least one opening and at least one septum that seals the at least one opening. The at least one septum (1) permits the flow of eluate from the generator into the at least one impurity trap when penetrated by the first fluid delivery system; (2) permits the flow of fresh eluent through the radioisotope trap when penetrated by the second fluid delivery system; (3) and permits the flow of the prepared radioisotope solution from the radioisotope trap to the sterile, collection vessel when penetrated by the third fluid delivery system.

In still another aspect of the invention, the container includes at least three openings, each sealed by a penetrable septum: (1) a first input septum that seals the first container opening and permits the flow of eluate from the generator into the at least one column when penetrated by the first fluid delivery system; (2) a second input septum that seals the second container opening and permits the flow of fresh eluent through the anion exchange column when penetrated by the second fluid delivery system; and (3) an output septum that seals the third opening and permits the flow of the prepared radioisotope solution from the anion exchange column to the sterile, collection vial when penetrated by the third fluid delivery system. The one step, sealed and drop in feature of this cartridge greatly simplifies set up clean up and minimizes operator exposure to radiation.

DETAILED DESCRIPTION OF THE PREFERRED EMBODIMENTS

The invention summarized above and defined by the enumerated claims may be better understood by referring to the following detailed description, which should be read in conjunction with the accompanying drawings. This detailed description of particular preferred embodiments, set out below to enable one to build and use particular implementations of the invention, is not intended to limit the enumerated claims, but to serve as a particular examples thereof. The particular examples set out below are the preferred specific implementations of an automated air over eluent radioisotope elution/concentration system and method, namely, one that automatically elutes rhenium-188 from a tungsten-188 adsorbed alumina column (W-188/Re-188) generator, concentrates the eluate to produce patient-grade sodium perrhenate solution and provides a self-contained, leak-proof, sealed concentration cartridge. The description also sets out below a preferred implementation of system for eluting multiple generators in series. The invention however, may also be applied to other types of radioisotope systems and equipment as well.

Figure 1:
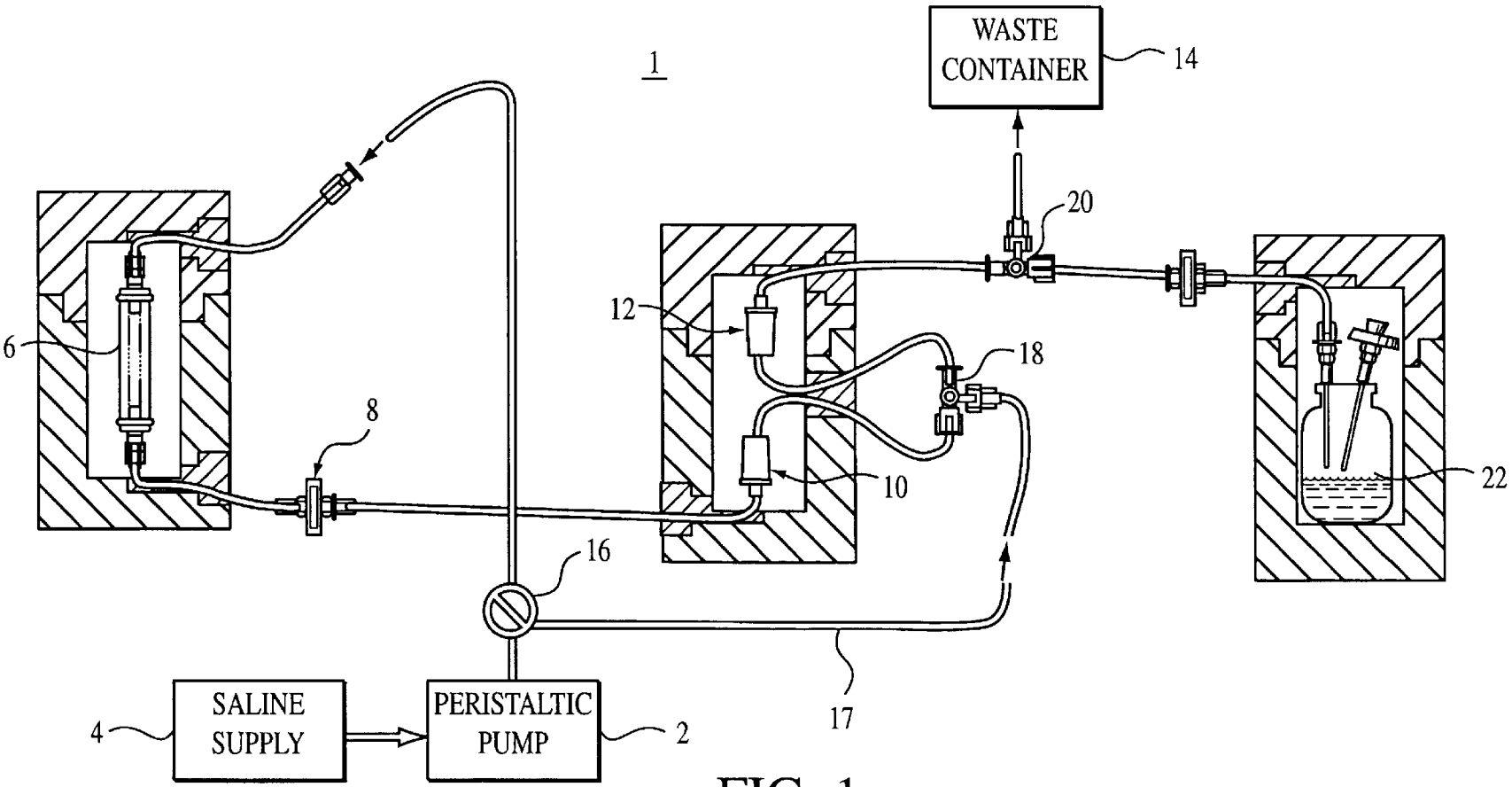
FIG. 1 PRIOR ART
FIG. 1 is an illustrative diagram of a conventional system for eluting a W-188/Re-188 generator and for concentrating the Re-188 eluate into a collection vessel.
Figure 2:
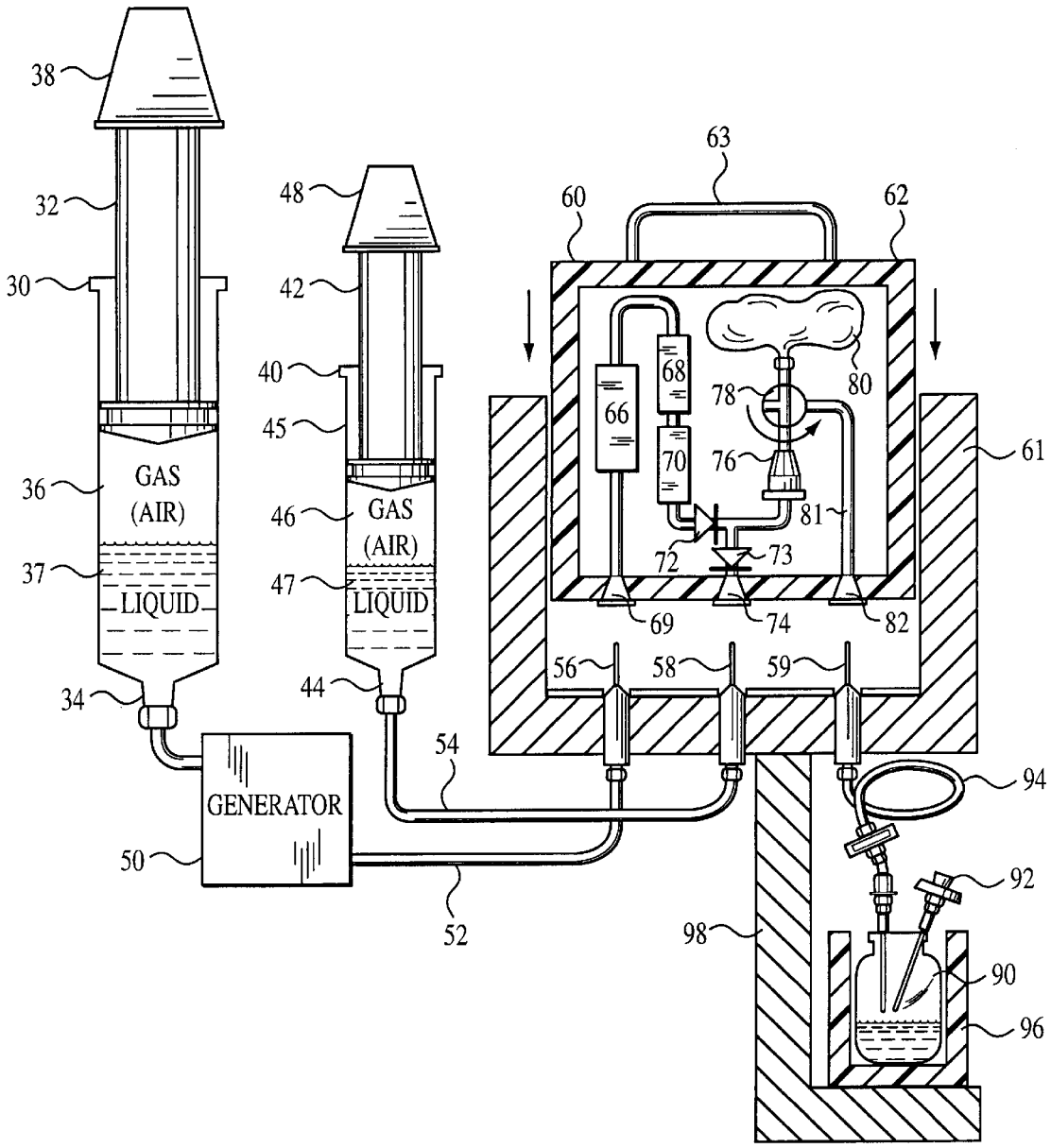
FIG. 2 illustrates the primary components of a preferred embodiment of the present invention, wherein one implementation of the air-over-water concept and one embodiment of the concentration cartridge subsystem are shown.

FIG. 2 illustrates the primary components of one preferred embodiment of the present inventive elution/concentration system. In particular, a first gas over eluent delivery mechanism 30 is shown in a vertically downward orientation. In this embodiment, the mechanism 30 is a syringe, which includes three components, namely, a barrel 31 defining a hollow cavity for containing fluid consisting of a first predetermined volume of gas 36, typically filtered air, positioned over a first predetermined volume of eluent, or liquid, 37, a plunger 32 placed within the hollow cavity and an output feed 34 to permit the eluent 37 and then gas 36 to travel through the system. The eluent may be a sterile saline solution or other acceptable solution.

A first pressure supplying source 38 supplies a downward force upon the plunger 32 which, in turn, forces the gas 36 and liquid 37 through the output feed 34 and into a radioisotope generator 50. In this embodiment, the source 38 is a simple weight having a mass, m1. A free weight, such as m1, is inherently a constant pressure source in that cannot supply a force to the plunger greater than the gravitational pull on it (as opposed to some motor-driven pumps, for example, that have the capacity to overdrive). This force limiting feature is very advantageous from a safety standpoint. In particular, in the event that a plug develops in any of the components or tubing of the system that cannot be overcome, or unplugged, by the force of the weight upon the fluid, the procedure will simply and safely come to a halt. However, it is understood that any conventional device for supplying a downward force upon the plunger is acceptable. For example, a compressed spring having a spring constant k, may supply a variable force upon the plunger. Alternatively, an electro-mechanical device such as a motor with torque (force) limiting properties, may safely supply the force.

Following the path of the fluid, the entire volume of the liquid 37 then passes through the W-188/Re-188 generator 50 and washes off the Re-188 radioisotope adsorbed on the generator column. The gas 36 follows immediately behind the liquid 37 to purge the generator of substantially all liquid contained therein. The solution, now carrying the desired radioisotope to be concentrated and called the "eluate," passes through the first elution tube 52 and is transported into a single-use concentration cartridge subsystem 60 via a hypodermic needle 56 which punctures a rubber septum 64 that serves as an inlet to the cartridge 60. As the mass 38 continues to force the plunger 32 downwardly, the eluate (and gas) then passes through a set of "impurity traps" 66, 68 and 70. These traps may consist of any chemical, radioisotope, or physical filters that are appropriate for the removal of undesirable components from the eluate. In the presently shown embodiment, the impurity traps are silver halide precipitation columns that are commercially available under the trade name "Maxi Clean Ic-Ag" columns (Alltech, Inc., Deerfield, Ill.). These traps are used to remove the chloride anions from the eluate, which if permitted to pass, would interfere with the trapping of the rhenium anions in the radioisotope trap. The eluate then passes through a check valve 72, which permits flow only in the direction of the arrow, and then through a radioisotope trap 76 that, as its name denotes, chemically traps the desired radioisotope therein and permits the passage of the solution through an adjustable three-way valve 78 and into a waste container 80. It should be understood that the radioisotope trap 76 may be any device that can accomplish the function of trapping the desired radioisotope. In the present embodiment, the trap 76 is an anion exchange column for concentrating thereon the perrhenate anion (Accell Plus QMA™ anion column, from Waters, Inc. Milford, Mass.). This completes the first step in the elution system of the present invention.

The second elution eluent volume is smaller than the first so that the isotope can be concentrated by the ratio of V1:V2; where V1 is the first elution volume and V2 is the second elution volume. Accordingly, the second, smaller gas over eluent delivery mechanism 40 provides the second stage elution procedure. In particular, the mechanism 40 is a syringe which stores a second measured volume of fluid containing a second measured volume of liquid 47 and a second volume of gas 46 positioned over the liquid 47. The syringe is comprised of a barrel 45, a plunger 42 and a output feed 44. A second pressure supplying source 48 is applied to the plunger 42 in order to force the second volume of fluid through the system as now described. It should be understood that, as described above with respect to the first delivery mechanism 30, the particular pressure supplying source 48 shown in FIG. 2 is a constant pressure mass, of weight w2, but may be any other acceptable pressure supplying source. Further, the liquid 47 is typically the same solution and the gas 46 is typically the same purified air as is used in the first mechanism. The liquid (then gas) passes through a tube 54 and into the concentration subsystem cartridge 60 through a rubber septum 74 via another hypodermic needle 58. The check valve 72 prevents the liquid and gas from flowing in the direction opposing the arrow, and thus is forced to flow through the QMA™ column 76. This time, the fresh eluent 47, since it contains chloride anions, "re-elutes" the perrhenate anion that is adsorbed on the column and combines with it as a sodium perrhenate solution that passes through tube 81, out of the cartridge 60 via the hypodermic needle 59, and into a beta-shielded product vial 90, or other suitable receptacle, via tube 94. As shown, a venting filter 92 is placed through the sealed vial opening to permit the gas to escape from the vial.

For the experimental system designed by the present inventors, the preferred volume of fluid for the first syringe 30 is 20–30 ml of eluent and 30–50 ml of gas. The preferred volumes in the second syringe 40 is 2–10 ml of eluent and 2–5 ml of gas. However, it should be understood that these figures are illustrative only and could, and likely will, be altered, depending on the desired final concentration of radioisotope, the size of the components, the distance the fluids must travel, and other factors.

Referring now to the inventive concentration subsystem 60, it is shown that all of the components necessary for concentrating an eluate is contained in this single-use, sealed cartridge. In the preferred embodiment, the cartridge is comprised of ⅜ inch plexiglass beta shielding on all sides 62 and includes a handle 63 for minimal operator handling. In this way, any undesirable parent radioisotopes, chloride anions, and eluate waste solution is completely contained within this cartridge. The cartridge can also be configured to allow simple assay of radioactive contaminants within the waste fluid and columns for quality control of the generator system. Thus, the set up for an elution procedure merely requires: (1) filling the two (or more) syringes with the proper quantity of fluid; and (2) the simple drop-in placement of the cartridge 60 within a lead shielding casing 61, causing the hypodermic needles 56, 58 and 59 to puncture the sealed rubber septums 64, 74 and 82. Further, when an elution/concentration operation is completed, the operator simply lifts the cartridge 60 out of the holder 61 via the handle and can dispose of the cartridge with minimal handling and minimal safety risk to the operator. In addition to operator safety, the cartridge system allows maintenance of a sterile and pyrogen-free environment over an extended time and many elutions.

Figure 3:
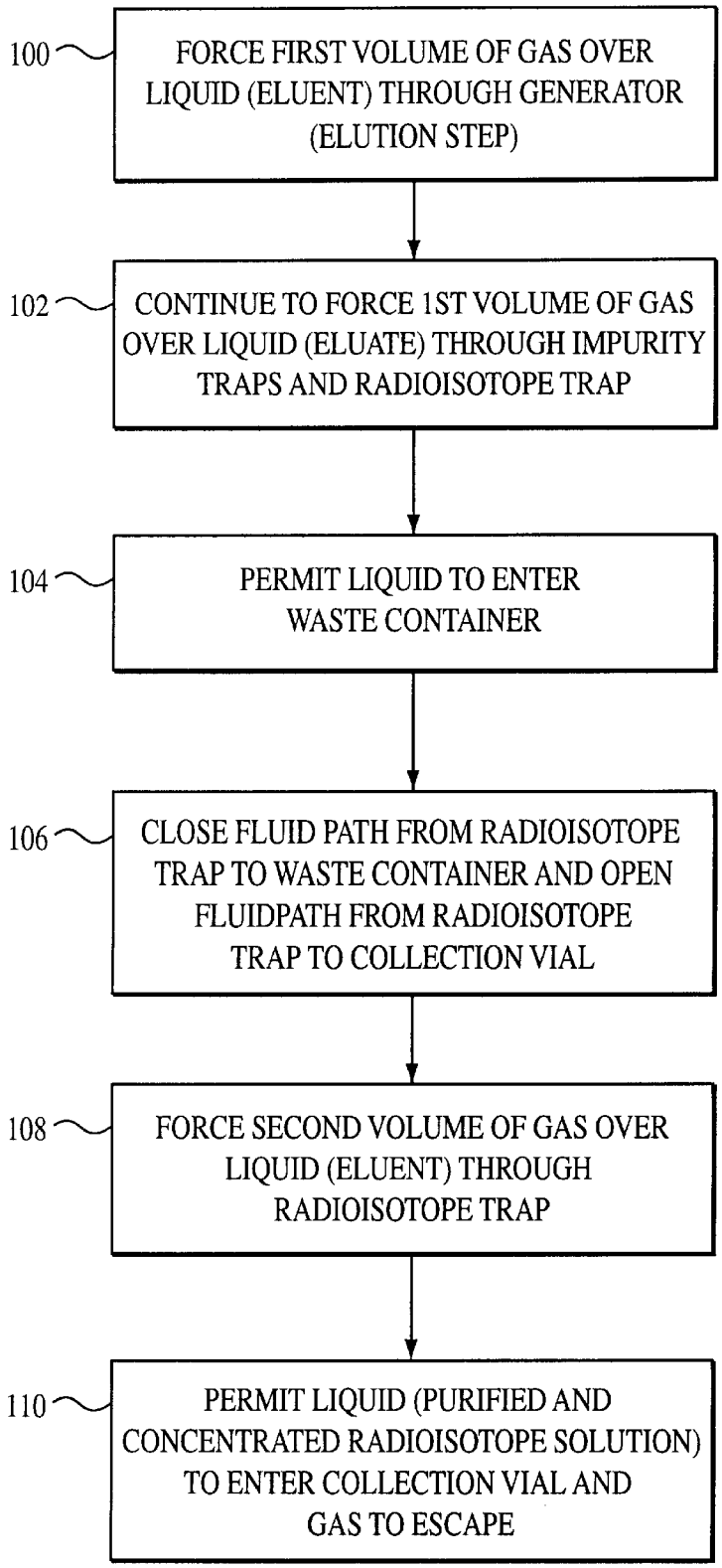
FIG. 3 is a flow chart showing one preferred method of practicing the present invention.

Turning now to FIG. 3, shown is a simple flow chart which describes a method employed by the present invention. After the system is set up, the first volume of gas over liquid (eluent) is forced through the generator in step 100 (the elution step). In step 102, the first volume of gas over liquid (now as eluate) is forced through the impurity traps and radioisotope trap (the concentration step). In step 104, this first volume of liquid is permitted to enter a waste container for disposal. At this point, the first elution procedure is completed and, in step 106 the three-way valve which is located adjacent the output of the radioisotope trap is switched from its initial position which permits flow from the radioisotope trap into the waste container to a second position which prevents flow from the radioisotope into the waste container but permits the flow to an output tube. This step may occur manually or, preferably, automatically via a sensor or limit switch which senses that the first elution is completed.

At this point, the second elution commences in step 108. In particular, a second volume of gas over liquid (eluent) is forced through the radioisotope trap thereby "lifting" the perrhenate anions that are trapped within. Finally, in step 110 this sodium perrhenate solution exits the concentration/elution system and enters as patient grade radio isotope solution into a sterile product vial.

Figure 4:
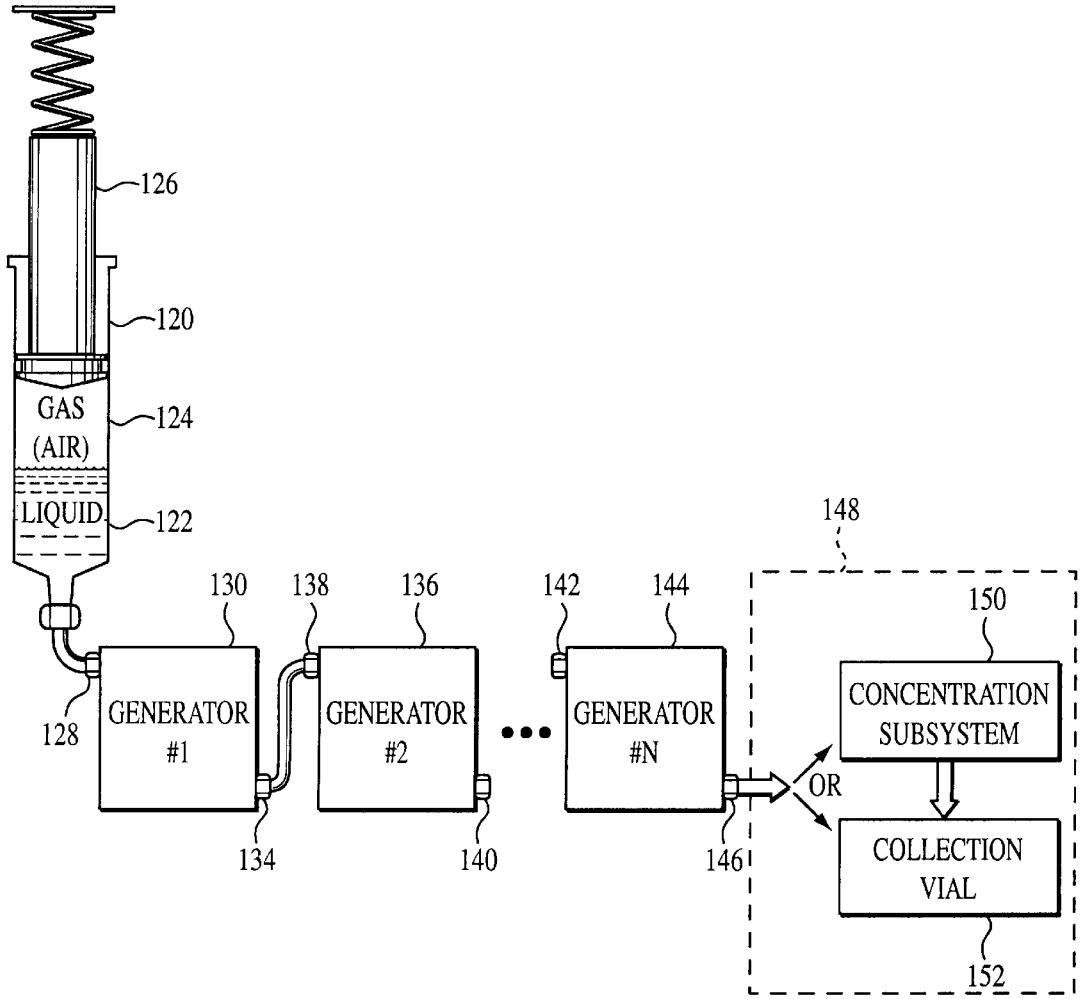
FIG. 4 is a diagram showing an improved elution system wherein multiple, in-series generators are eluted with a single quantity of eluent using the air-over eluent concept.
Figure 2:
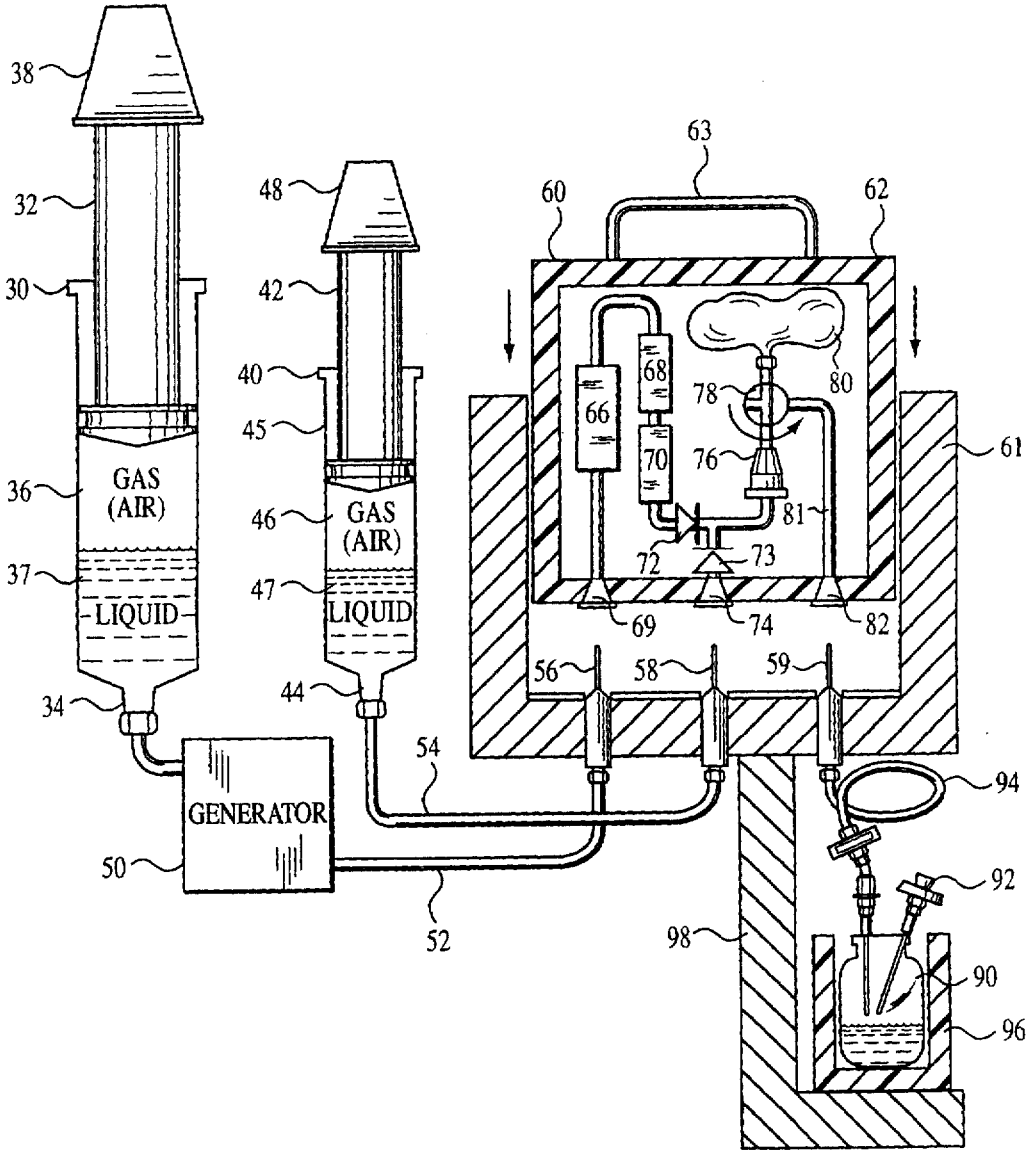

FIG. 4 shows the novel gas over eluent delivery mechanism 120 being used advantageously to elute multiple radioisotope generators in series. In particular, the mechanism 120, loaded with liquid eluent 122 and a gas 124, is connected to the first radioisotope generator 130 via the generator's inlet 128. A plunger 126 forces first the eluent 122 and then the gas 124 through the generator 130 and exits at its outlet 134 as an eluate. The gas 124 continues to force the liquid into a second generator 136 having an inlet 138 and outlet 140, thereby eluting the radioisotope adsorbed on this generator 136 as well. The outlet 140 of this generator may be fed into subsequent generators that are connected in series. The last generator n 144 has an outlet 146 which produces the eluate to be further processed in processing box 148. In particular, the eluate may be further processed in a concentration subsystem 150 as described above with reference to FIGS. 2 and 3, and then collected in a collection vial 152. Alternatively, in procedures that do not require a second concentration and elution step, the eluate that is output from the generators may enter directly into the collection vial 152.

It should be understood that this mechanism 120 may be used to advantageously elute two used generators 130 and 136 in series or more. The number of generators that can be eluted in series is limited, theoretically, only by the size of the delivery mechanism 120 and the volume of gas 124 preloaded therein. In particular, there must be sufficient gas in the mechanism to completely purge all of the generators (and a concentration subsystem 150, if employed) of liquid.

Having thus described exemplary embodiments of the invention, it will be apparent that further alterations, modifications, and improvements will also occur to those skilled in the art. Further, it will be apparent that the present concentration system is not limited to use with a W-188/Re-188 generator. Systems that produce other radioisotopes can also be improved using the system and method described herein. Such alterations, modifications, and improvements, though not expressly described or mentioned above, are nonetheless intended and implied to be within the spirit and scope of the invention. Accordingly, the foregoing discussion is intended to be illustrative only; the invention is limited and defined only by the various following claims and equivalents thereto.

What is claimed is:

1. A gas-over-eluent, fluid delivery mechanism for eluting one or more processing elements having inlets and outlets, comprising:

a reservoir having an output feed at the bottom thereof for connecting to the inlet of one of the one or more processing elements;

a predetermined volume of eluent contained in the reservoir;

a predetermined volume of gas contained in the reservoir, separated from and positioned over the predetermined volume of eluent; and a force-limited, pressure-supplying mechanism that forces the volume of eluent and then the volume of gas through the reservoir output feed and into and through the one or more processing elements, thereby eluting the one or more processing elements with the predetermined volume of eluent and purging the one or more processing elements with the predetermined volume of gas.

2. The mechanism of claim 1, wherein:

the reservoir is a syringe; and the pressure-supplying mechanism includes:

a plunger having a head positioned within said syringe and over the volume of gas; and a plunger pressure source that applies a downward force upon the plunger, the volume of gas, and thus the volume of eluent, in order to propel the eluent and then the gas through the syringe, and through the one or more processing elements.

3. A system for producing a radioisotope solution, comprising:

at least one processing element each having an inlet and outlet;

a reservoir having an output feed at the bottom thereof for connecting to the inlet of one of the at least one processing element;

a predetermined volume of eluent contained in the reservoir;

a predetermined volume of gas contained in the reservoir, separated from and positioned over the predetermined volume of eluent; and a force-limited, pressure-supplying mechanism that forces the volume of eluent and then the volume of gas through the reservoir output feed and into and through the at least one processing element, thereby eluting the at least one processing element with the predetermined volume of eluent and purging the one or more processing elements with the predetermined volume of gas.

4. The system of claim 3, wherein the at least one processing element is a radioisotope generator having an input connected to the output feed of the reservoir.

5. The system of claim 3, wherein the at least one processing element includes at least two radioisotope generators connected in series.

6. The system of claim 3, wherein the at least one processing element includes at least one radioisotope generator and at least one of a radioisotope concentration component and radioisotope purification component.

7. A method for eluting a desired volume of a daughter radioisotope solution through at least one radioisotope processing element using a gas-over-eluent delivery mechanism in fluid communication with the at least one processing element, the method comprising:

preloading the delivery mechanism with a predetermined volume of eluent and a predetermined volume of gas positioned over the volume of eluent; and applying a pressure directly upon the volume of gas to force the volume of eluent followed by the volume of gas through the at least one processing element at a predetermined rate.

8. A system for producing a concentrated radioisotope through a series of elution steps, comprising:

(a) at least one generator for producing an eluate containing a desired radioisotope to be concentrated;

(b) a radioisotope concentration subsystem having at least one processing element in fluid communication with the generator that processes the radioisotope therein;

(c) a radioisotope collection vessel in fluid communication with the concentration subsystem for collecting therein a desired volume of prepared radioisotope solution;

(d) a first gas-over-eluent delivery mechanism in fluid communication with the generator, that stores a first measured volume of fluid which includes a first measured volume of eluent solution and a first measured volume of a gas positioned over the first volume of solution, the mechanism including a first pressure-supplying source that applies a first pressure upon the first volume of gas to force the first volume of eluent and then gas through the generator and the radioisotope concentration subsystem; and (e) a second gas-over-eluent delivery mechanism in fluid communication with the concentration subsystem, that stores a second measured volume of fluid which includes a second measured volume of eluent solution and a second measured volume of a gas positioned over the second volume of solution, the second mechanism including a second pressure-supplying source that applies a second pressure upon the second volume of gas to force the second volume of eluent and then gas through the concentration subsystem and into the radioisotope collection vessel, thereby re-eluting the radioisotope at a desired concentration.

9. The system of claim 8, wherein the first delivery mechanism further includes a first, downwardly-positioned syringe having a barrel defining a hollow cavity for containing therein the first volume of fluid and including an outlet, and a plunger placed within the hollow cavity, the first syringe being substantially vertically positioned so that the outlet is at the bottom and the plunger is at the top, and wherein the first pressure-supplying source is connected to the plunger, and the second delivery mechanism further includes a second, downwardly-positioned syringe having a barrel defining a hollow cavity for containing therein the second volume of fluid and including an outlet, and a plunger placed within the hollow cavity, the second syringe being substantially vertically positioned so that the outlet is at the bottom and the plunger is at the top and wherein the second pressure supplying source is connected to the plunger.

10. The system of claim 9, wherein the first and second pressure-supplying sources are constant pressure sources.

11. The system of claim 10 wherein the first constant pressure source is a first mass having a predetermined weight and the second constant pressure source is a second mass having a predetermined weight.

12. The system of claim 9, wherein the first and second pressure-supplying sources are variable-rate, pressure-supplying sources.

13. The system of 12 wherein the first pressure supply source is a first spring having a predetermined spring constant and the second pressure supply source is a second spring having a predetermined spring constant.

14. The system of claim 8, wherein the at least one processing element comprises at least one impurity trap in fluid communication with the generator for removing impurities from the eluate, a radioisotope trap in fluid communication with the at least one impurity trap for concentrating therein the desired radioisotope in the eluate and for permitting the passage of the eluate therethrough for disposal, and wherein the second gas-over eluent delivery mechanism forces the second measured volume of eluent and then the second measured volume of a gas into and through the radioisotope trap and into the radioisotope collection vessel.

15. The system of claim 9, further including a waste receptacle for receiving the eluate produced by the generator and passed by the radioisotope trap.

16. The system of claim 15, wherein the waste receptacle is integral with the radioisotope concentration subsystem.

17. The system of claim 8, wherein the first gas-over-eluent delivery mechanism is connected to the second delivery mechanism so that the second pressure-supplying source is applied to the second measured volume of fluid only after the first delivery mechanism is depleted of its first volume of fluid.

18. A method for automatically eluting a desired volume of a daughter radioisotope from a parent radioisotope contained in at least one generator using a first, gas-over-eluent delivery mechanism containing a first measured volume of gas positioned over a first measured volume of eluent, the mechanism in fluid communication with the at least one generator, for automatically concentrating the resultant eluate in a concentration subsystem having at least one impurity trap in series with a radioisotope trap having an inlet and outlet, and for re-eluting a daughter radioisotope solution into a sterile, vented, collection vessel with a second, gas-over-eluent, storage and delivery mechanism containing a second, measured volume of gas positioned over a second, measured volume of eluent, the method comprising:

applying a first pressure on the first volume of gas to force the first volume of eluent and then the first volume of gas through the generator and concentration subsystem and into a fluid waste receptacle, thereby eluting the daughter radioisotope from the generator, concentrating the resultant eluate, and purging the generator, the at least one impurity trap and the radioisotope of eluate; and applying a second pressure on the second volume of gas to force the second volume of eluent, and then the second volume of gas through the concentration subsystem and into the sterile, vented collection vessel, thereby re-eluting the concentrated daughter radioisotope into the collection vessel and purging the concentration subsystem of fluid.

19. The method of claim 18, further including sensing that the applying of the first pressure on the first volume of gas is completed, and wherein the applying of the second pressure on the second volume of gas commences only upon such sensing.

20. The method of claim 19, wherein the applying if the second pressure is automatic.

21. A single-use, self-sealed, radioisotope concentration cartridge for processing therein a radioisotope contained in an eluate solution generated by a radioisotope generator and carried by a fluid delivery system, thereby preparing the radioisotope to be delivered into a sterile, collection vial, the cartridge comprising:

at least one eluate processing element; and a sealed, radioactively-shielded, container that houses the at least one eluate processing element, the container having at least one opening and further including, at least one septum that seals the at least one opening and that permits the flow of eluate from the generator into and through the at least one eluate processing element, and to the collection vial when penetrated by the fluid delivery system.

22. The cartridge of claim 21, wherein the container further includes a visual indicator that identifies whether the container has been used in a prior elution procedure.

23. The cartridge of claim 21, wherein the container further includes a quality control indicator that identifies a condition, such as pH, chemical purity or biological purity, of the eluate contained therein.

24. The cartridge of claim 21, wherein the container is shaped to fit into a radiation well chamber that identifies breakthrough activity of a parent radioisotope from the generator.

25. A single-use, self-sealed, radioisotope concentration cartridge for concentrating therein a radioisotope contained in an eluate solution generated by a radioisotope generator and carried by a first fluid delivery system, thereby preparing the radioisotope to be re-eluted by a second fluid delivery system and to be carried into a sterile, collection vial via a third fluid delivery system, the cartridge comprising:

at least one impurity trap;

a radioisotope trap serially connected to the at least one impurity trap; and a sealed, radioactively shielded, container that houses the at least one impurity trap and radioisotope trap, the container having at least one opening and further including, at least one septum that seals the at least one opening and that permits the flow of eluate from the generator into the at least one impurity trap when penetrated by the first fluid delivery system, permits the flow of fresh eluent through the radioisotope trap when penetrated by the second fluid delivery system, and permits the flow of the prepared radioisotope solution from the radioisotope trap to the sterile, collection vial when penetrated by the third fluid delivery system.

26. The cartridge of claim 25, wherein the container includes at least three openings and the at least one septum includes a first input septum that seals the first container opening and permits the flow of eluate from the generator into the at least one impurity trap when penetrated by the first fluid delivery system, a second input septum that seals the second container opening and permits the flow of fresh eluent through the radioisotope trap when penetrated by the second fluid delivery system, and an output septum that seals the third opening and permits the flow of the prepared radioisotope solution from the radioisotope trap to the sterile, collection vial when penetrated by the third fluid delivery system.

27. The cartridge of claim 25, further including an eluate waste receptacle sealed within the container that is in fluid communication with the output of the radioisotope trap for collecting therein eluate waste from the first elution.

* * * * *

UNITED STATES PATENT AND TRADEMARK OFFICE

CERTIFICATE OF CORRECTION

PATENT NO. : 6,157,036
DATED : December 5, 2000
INVENTOR(S) : Whiting et al.

It is certified that error appears in the above-identified patent and that said Letters Patent is hereby corrected as shown below:

Drawings,
Sheet 2 of 4, please insert therefor the substitute figure 2 indicating check valve 73 as an up-pointing arrow.

Signed and Sealed this

Seventh Day of May, 2002

*Attest:*

*Attesting Officer*

JAMES E. ROGAN
*Director of the United States Patent and Trademark Office*